United States Patent [19]

Nystad

[11] Patent Number: 5,065,465

[45] Date of Patent: Nov. 19, 1991

[54] WATER MATTRESS FOR A THERAPY WATER BED

[76] Inventor: Jan Nystad, Elverhøy, N-2312, Ottestad, Norway

[21] Appl. No.: 613,894

[22] PCT Filed: Jun. 13, 1989

[86] PCT No.: PCT/NO89/00057

§ 371 Date: Dec. 6, 1990

§ 102(e) Date: Dec. 6, 1990

[87] PCT Pub. No.: WO89/12414

PCT Pub. Date: Dec. 28, 1989

[30] Foreign Application Priority Data

Jun. 13, 1988 [NO] Norway ..... 882591

[51] Int. Cl.[5] ..... A47C 27/10

[52] U.S. Cl. ..... 5/450; 5/451; 5/455; 5/464

[58] Field of Search ..... 5/450, 451, 452, 455, 5/449, 422, 441, 464

[56] References Cited

U.S. PATENT DOCUMENTS

| | | | |
|---|---|---|---|
| 3,605,145 | 9/1971 | Graebe | 5/455 |
| 4,109,333 | 8/1978 | Zmiarovich | 5/451 |
| 4,558,476 | 12/1985 | Linder | 5/451 |
| 4,698,864 | 10/1987 | Graebe | 5/455 |
| 4,727,607 | 3/1988 | Nystad | 5/451 |
| 4,901,386 | 2/1990 | Lane | 5/451 |

*Primary Examiner*—Alexander Grosz

*Attorney, Agent, or Firm*—Rodman & Rodman

[57] ABSTRACT

An arrangement in a water mattress (1) for a water bed, the water mattress (1) comprising a water bag (2) made from a flexible and water tight sheet material, which is provided in a frame (3) of a resilient material, intended to be supported, in use, by a firm surface, and where bottom (4) and top (5) of water bag (2) are mutually connected alongside the upper narrow edge (3*a*) of said resilient frame, the top of water bag (2) being secured to the frame (3). The bottom (4) of water bag (2) is in contact with inner inclined lateral surfaces (3*b*) of frame (3) and the supporting surface. Bottom (4) of water bag (2) is double with an intermediate air chamber (8) connected with a hose (9) for air supply. In top surface (8*a*) of air chamber (8) upwards projecting flexible air pockets (10) are provided which open towards air chamber (8).

When air is supplied to air chamber (8) and air pockets (10), the air pockets will displace water in water bag (2), so that a person lying on the supporting surface of the water mattress will be supported by water and air in said air pockets (10).

9 Claims, 1 Drawing Sheet

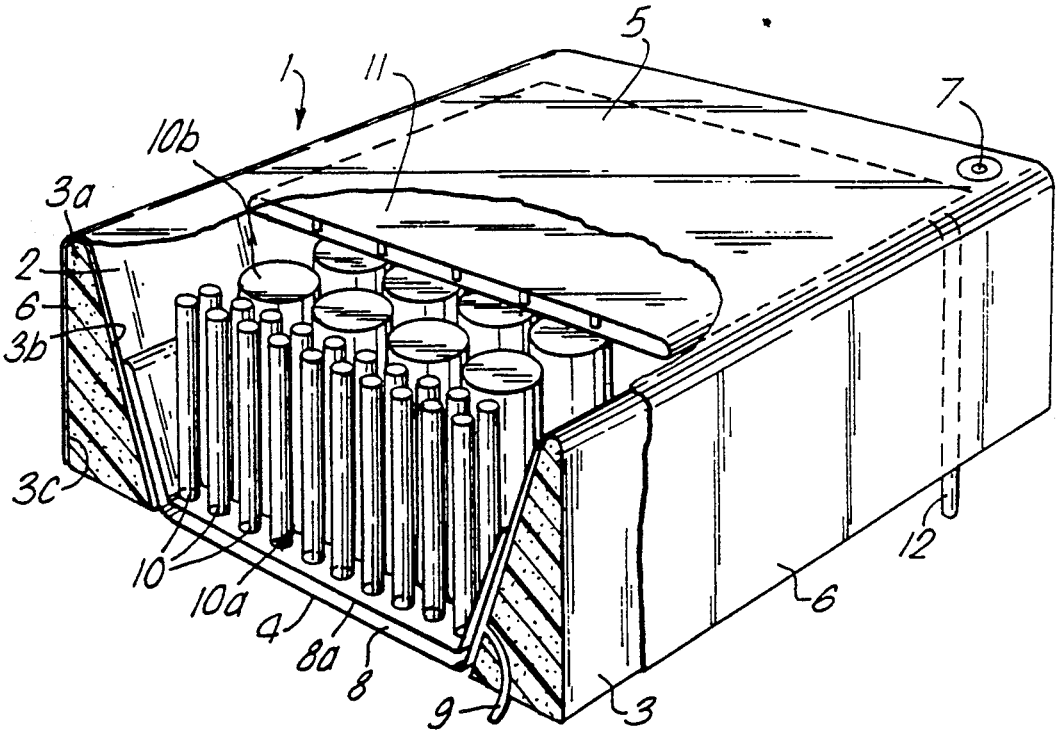
1
11
5
7
10b
3a
2
6
3b
3c
10
10a
4
8a
8
9
3
6
12

WATER MATTRESS FOR A THERAPY WATER BED

The present invention relates to an arrangement in a water mattress for a water bed, especially for a therapy water bed.

A well-known problem in connection with water beds, and therapy water beds is the large volume of water required to achieve sufficient depth of water, so that the user will not bump on the bottom of the bed when lying in a lateral position or sitting up.

Various attempts have been made to solve this problem, e.g. by shaping a firm bottom to be most shallow in areas where the user's body will not sink down in the bed, e.g. at the foot end of a therapy water bed or for a water mattress to be used in ordinary beds. In connection with use of water mattress bags it is also known to raise the flexible bottom of the bag by inflating air hoses located between the firm support and the bottom of the water bag, or to shape the firm bottom by providing bags which are filled with plastic spheres on said bottom before the water bag is placed on top and is filled with water. If such a bed is to be used by different persons with differing body weight, it has to be adapted to the weight of individual users. This is the case, especially when such water beds are used in hospitals, where a series of different persons will use the water bed/beds and where the weight of such a water bed is of importance in case of transport into and out of wards and to and from therapy posts. In such circumstances it is rather important to be able to provide a water bed in which the volume of water can always be adjusted to a minimum depending on the user's body weight.

In order to insert bags of plastic spheres to shape the firm bottom, the water mattress bag proper must be readily accessible from outside, and water must be discharged. Shaping of the water mattress bag bottom by inflating balloons or hoses under said bottom of the water mattress bag requires high air pressure, and shaping the bottom beyond a shape given in advance wil be difficult because air balloons/hoses must be produced from reinforced plastic or rubber. Flexibility is thus reduced and so is the possibility of individual shaping of the bottom to achieve maximum weight reduction. Additionally, the bottom of the water bed will become stationary because of the high pressure required below the bottom of the water bag to raise the latter with its water content and to support the user.

To be able to shape such a bottom of a water bed according to requirements, e.g. by making it deeper in the central area when the user is to sit up, and more shallow below the area of the user's back to reduce the volume of water, e.g. air must be pumped out of said central area of the user's buttocks to the area of the water bed where the user's back is placed. This requires division of the inflatable hoses/balloons into groups, i.e. a central, an upper, and if desired, a lower section in the water bed. This, furthermore, reqires a carefuly controlled operation to maintain a constant volume of water to avoid adjustment of the volume of water, and an air pump will be necessary all the time to pump air between ballons of the different sections.

It is an object of the present invention to provide an arrangement in a water mattress for a water bed, especially for a therapy water bed, as mentioned above, where the above disadvantages are eliminated.

According to the present invention a water mattress of the kind mentioned above is, thus, achieved, where the bottom of the water bag is double with an intermediate air chamber which is connected with a hose for air supply. In the top face of the air chamber air pockets are provided, made from an air/water tight flexible material and projecting upwards and opening towards the air chamber. When air is supplied to said chamber the chamber and the air pockets will be filled and will partly fill the space of the water mattress inside the water bag, thus, partly to replace the necessary volume of water by a volume of air. Water in the water bag will then be located above the air chamber, in the bottom of the water bag, and between projecting air pockets. The air pockets preferably extend to the upper face/top of the water bag. Between said top and the upper ends of the air pockets an inflatable air mattress connected with a hose for supply of air may advantageously be placed.

The air pockets may, if desired, be connected in groups as required for replacement of water by air in groups along the extent of the water bag, so that it is possible to remove most of the water where it is not momentarily required, and to maintain water at locations where the user sinks down into the surface of the water mattress, e.g. below the user's buttocks when the user is sitting up in the water bed, or when the user is lying in a lateral position, with the user's hip sinking down into the mattress. The effective volume of the air pockets may be adjusted by air pressure. Individual adjustment of the volume of water in different areas of the water bag is, thus, possible in a simple manner by the aid of low pressure air. Furthermore, water can be discharged from the water bag by increase of the pressure in the air pockets and, thus, their volume. The effective volume of the air pockets may also, if desired, be reduced by discharge of air, so that water may be supplied to the water bag to adapt it to the user's weight.

In areas of the water mattress where adaption will often be required, e.g. beneath the user's back and buttocks when the user shifts over from his/her back to a lateral position or to sit up, the air pockets may be narrow and elongated, i.e. with a small cross section, and may be compared with, e.g. like "intestinal villi". By keeping up a constant air pressure in said narrow air pockets, together with ambient water they will provide a certain support to the user lying in the water mattress bed. When the user either turns to a lateral position or sits up in the bed, the narrow air bags will be pushed aside in the areas in question in the water bag and ambient water will flow along under the surface of the water bag with an increased load, to thus increase buoyancy in this area. By such narrow air pockets or "intestinal villi" with constant pressure in areas of the water bed mattress where adjustment is empirically most often required, constant adjustment of the volumes of air and water in the water bag for adaption to the user's sitting and lying positions will be eliminated.

By use of air pockets with large cross sections—large volumes—in areas of the water mattress bag where readaption is empirically not required after adaption of the water mattress bed to the individual user, such areas, e.g. the foot end of the water bed, may be made to contain almost no water by inflating the air pockets to displace water in said areas. In areas with narrow air pockets intended to flex off under pressure, there must be a little space between the air pockets. When a few air pockets are flexed down, e.g. at the foot end of the water bed or below the user's buttocks when the user sits up, or below the shoulders when the user is in a lateral position, the air bags will be forced down into the water and to flex laterally, and air will be distributed to the other pockets and into the air chamber in the double bottom of the water bag, and possibly, into a part of the double bottom which may extend slightly uppwards along the inner surface of the surrounding frame.

When the load and, thus, pressure, is reduced in the air pockets of interest, air will flow back to said flexed-down air pockets and they will raise and resume their original position. The air volume enclosed in the air pockets will, thus, flow from an area of great pressure/-load to an area of less pressure/load, and will readjust to the original distribution of air when the load is removed. In this manner the volume of water in the water bag may be kept constant, irrespective of how the user is lying or sitting. Maximum reduction of the water volume can, thus, be achieved at the same time as the required water depth and buoyancy can always be maintained without adaption of the shape of the bottom from outside. The necessary volume of water is adjusted inside the water bag by the aid of said air pockets, wheras the shape of the water bag bottom is constant. With a water mattress comprising a water bag according to the invention it is, in principle, also possible to lift the water bag, e.g. at the head of the water mattress to achieve a back rest for a person sitting up. Water will then flow down to the central and foot end portions of the water mattress and increase the pressure against air pockets in said areas. Additionally the air pockets beneath the user's buttocks are pressed down. Air in the air pockets will, thus be forced up into the air pockets at the back and head areas of the water bag to increase air pressure there, so that the latter air pockets will support the user's back and head. When the air pockets extend all the way up to the supporting/top surface of the water bag, the water mattress will maintain its external shape in the area of the user's back. A user sitting in bed will, thus, have the necessary volume of water beneath his/her buttocks to achieve correct distribution of pressure and support for his/her back.

Another advantage of the present invention is that when the air mattress being loosely arranged between the top surface of the water bag and the air pockets in the water bag, is inflated the air mattress will press down against underlying air pockets and the top of the water mattress. The air mattress will, thus, distribute the weight of a lying person to a large number of air pockets. The higher pressure there is in the air mattress, the more rigid it will become, and the more air pockets will receive the user's weight. In this manner the support surface of the water mattress may be reduced from a firm support in case of a completely inflated air mattress, to a quite soft supporting surface when the air mattress is not inflated.

An embodiment of the invention will be disclosed below with reference to the only FIGURE of the drawing which shows an embodiment of the invention in perspective and cross section.

The drawing, thus, shows a water mattress 1 for a water bed. Water mattress 1 comprises a water bag 2 made from a flexible water-proof textile material and provided in a frame 3 of a resilient material, e.g. foam rubber. Water bag 2 with surrounding frame 3 is intended to be supported by a firm surface, e.g. the bottom of the bed. Bottom 4 and top 5 of water bag 2 are connected along the narrow upper edge 3*a* of the resilient frame 3. The top/supporting surface 5 of water bag 2 with lateral extensions 6 is stretched across upper edge 3*a* and lateral outer surface 3*c* of frame 3 and is secured in a suitable manner. Bottom 4 of water bag 2 is in contact with inner inclined lateral faces 3*b* of frame 3 and the supporting surface. Water bag 2 is provided with a valve 7 for filling up, and discharging water, respectively.

Bottom 4 of water bag 2 is a double layer with an intermediate air chamber 8 which is connected with a hose 9 for air supply. Top surface 8*a* of air chamber 8 comprises upwards projecting air pockets 10, which open towards the air chamber and are manufactured from an airtight/watertight resilient material. The air pockets are elongated and provided all over the top surface 8*a* of air chamber 8. Preferably, air pockets 10 are approximately cylindrical (sausage shaped) and they are narrowly spaced all over said top surface 8*a* and extend to the top 5 of water bag 2.

Air pockets 10 may be arranged in groups 10*a*, 10*b*, as shown, with different cross sectional dimensions to achieve different volumes in a fully inflated state.

Air chamber 8 may be divided into sections corresponding to groups 10*a*, 10*b* of air pockets 10. Each air chamber section may be connected with a hose for supply of air for individual adjustment.

Air pockets 10 with large cross sectional dimensions—large volumes—may, e.g. be provided at the foot end of water mattress 1 and, if desired, at its head, i.e. in areas of the water mattress where water bag 2 is subjected to lower lumped loads than in the central area of water bag 2.

Between the upper ends of air pockets 10 and top 5 of water bag 2 an inflatable air mattress 11 may be provided, as shown in the drawing, connected with a hose 12 for air supply.

The supporting surface of water mattress 1 may be adjusted to be more firm or soft by increase or decrease of the air pressure in air mattress 11.

Air chamber 8 between the double large bottom of water bag 2 may extend upwards alongside at least two of the opposed inner inclined lateral surfaces 3*b* of frame 3, preferably the elongated lateral edges of frame 3. In this manner an effect of water displacement is achieved adjacent to frame 3.

Air chamber 8 in water bag 2 may be divided into three sections with air pockets 10 having large cross sectional dimensions in two outer air chamber portions, and air pockets 10 with small cross sectional dimensions in the central air chamber section. In this manner good support is achieved in case of high lumped loads in the central area of the water mattress, whereas both end sections contain less water because lumped loads there, at the foot and head ends, are commonly lower. In this manner the volume of water is reduced in said end areas and the total weight of the water mattress is reduced.

I claim:

1. A water mattress for a water bed supported on a firm rigid surface comprising, a water bag of resilient water-tight sheet material, a frame of resilient foam material forming a wall around said water bag, said frame having a top free edge, a bottom base portion, an inner side surface and an outer side surface, said water bag having a top portion with lateral extensions depending alongside the outer side surface of said frame, said top portion being stretched across the top free edge of said frame and secured to said frame, said water bag further including a bottom portion extending along the inner side surface of said frame from the bottom base portion of the frame to the top edge of the frame, said top and bottom portions of said water bag being joined along the top free edge of said frame, a valve for dispensing water into said water bag and discharging water from said water bag, and wherein the bottom portion of said water bag includes two layers of said resilient water-tight sheet material with a space therebetween to define an intermediate air chamber, an air hose communicable with said air chamber to supply air to said air chamber and a plurality of hollow inflatable cylindrical air pocket members communicable with said air chamber and extending upwardly from the bottom portion of said water bag toward the top portion of said water bag and being free from connection with the top portion of said water bag.

2. A water mattress as claimed in claim 1 wherein said inflatable cylindrical air pocket members are elongated and distributed on the bottom portion of said water bag up to said frame.

3. A water mattress as claimed in claim 1 wherein said inflatable cylindrical air pocket members have at least two different cross-sectional dimensions to provide two different volumes for said inflatable cylindrical air pocket members.

4. A water mattress as claimed in claim 3 wherein said air chamber is divided into predetermined sections, and wherein air pocket members of corresponding cross-sections are grouped together, each said group being at a respective predetermined section of said air chamber and each said air chamber section being connected with a respective predetermined hose for supply of air.

5. A water mattress as claimed in claim 3 wherein said water mattress has opposite head and foot end portions and wherein said air pocket members of corresponding cross-sections are grouped together, one of said groups of cylindrical air pocket members having a first volumetric capacity being provided at the head and foot ends of the water mattress and the other said group of cylindrical air pocket members having a second volumetric capacity being provided intermediate the head and foot end portions of said water mattress.

6. A water mattress as claimed in claim 5 wherein the first group of inflatable cylindrical air pocket members have a larger volumetric capacity than the second group of inflatable cylindrical air pocket members.

7. A water mattress as claimed in claim 1 wherein an inflatable air mattress is provided between the upper free ends of said inflatable cylindrical air pocket members and the top portion of said water bag, said inflatable air mattress including a hose for supplying air to said air mattress.

8. A water mattress as claimed in claim 1 wherein said frame is generally rectangular around said water bag and the inner side surface inclines away from the outer side surface in a direction from the top free edge portion to the bottom base portion of said frame and said air chamber extends alongside at least two opposite inner side surfaces of said frame.

9. A water mattress as claimed in claim 1 wherein said water mattress has opposite head and foot end portions and said air chamber is longitudinally divided into a head end section, a foot end section and an intermediate section between the head and foot end sections and the inflatable cylindrical air pocket members at the head end section and the foot end section are of larger cross section than the inflatable cylindrical air pocket members at the intermediate section.

* * * * *